US006012934A

United States Patent [19]

Aoki et al.

[11] Patent Number: 6,012,934

[45] **Date of Patent: *Jan. 11, 2000**

[54] LIF CONNECTOR WITH A SLIDER AND RETAINING PROJECTION

[75] Inventors: Hiroshi Aoki; Motohisa Kashiyama, both of Shizuoka, Japan

[73] Assignee: Yazaki Corporation, Tokyo, Japan

[ * ] Notice: This patent is subject to a terminal disclaimer.

[21] Appl. No.: 08/998,597

[22] Filed: Dec. 29, 1997

[30] Foreign Application Priority Data

Jan. 8, 1997 [JP] Japan ..... 9-001565

[51] Int. Cl.[7] ..... H01R 13/62

[52] U.S. Cl. ..... 439/157

[58] Field of Search ..... 439/157, 152, 439/153, 347, 344, 270, 953

[56] References Cited

U.S. PATENT DOCUMENTS

| | | | |
|---|---|---|---|
| 5,169,327 | 12/1992 | Hatagishi | 439/157 |
| 5,183,408 | 2/1993 | Hatagishi | 439/157 |
| 5,478,251 | 12/1995 | Jaklin | 439/157 |
| 5,618,194 | 4/1997 | Maue et al. | 439/157 |
| 5,618,195 | 4/1997 | Cappe | 439/157 |
| 5,816,833 | 10/1998 | Hanazaki | 439/157 |
| 5,839,912 | 11/1998 | Schekalla et al. | 439/157 |
| 5,857,859 | 1/1999 | Machill et al. | 439/157 |
| 5,902,141 | 5/1999 | Iwahori | 439/157 |

*Primary Examiner*—Khiem Nguyen
*Assistant Examiner*—Michael C. Zarroli
*Attorney, Agent, or Firm*—Sughrue, Mion, Zinn, Macpeak & Seas, PLLC

[57] ABSTRACT

There is disclosed an LIF (low insertion force) connector in which a slider can be positioned with a simple construction, and an insertion/withdrawal force, required for inserting and withdrawing a connector relative to a mating connector, can be reduced, and wear and deformation of a slider-retaining portion can be positively prevented. In the LIF connector, a driven shaft of a second connector is inserted into a through hole formed in a first connector, and a slider, having cam grooves, is slid over the first connector to linearly move the driven shaft, thereby inserting and withdrawing the second connector relative to the first connector. A retaining projection, which stops the sliding movement of the slider, and positions inlets of the cam grooves relative to the through hole in the first connector, is formed on the first connector at a substantially rearmost end of an extent of sliding movement of the slider.

14 Claims, 16 Drawing Sheets

LIF CONNECTOR WITH A SLIDER AND RETAINING PROJECTION

BACKGROUND OF THE INVENTION

This invention relates to an LIF connector having an LIF (low insertion force) mechanism by which a multi-pole connector, having many terminals, can be easily inserted into and withdrawn from a mating connector.

The term "connector", used in this specification of the present invention, means a connector including at least male terminals or female terminals, and a housing receiving these terminals therein, and the housing may be either separate from or integral with other member.

A multi-pole connector has a plurality of terminals, and therefore a large insertion/withdrawal force is required for inserting and withdrawing the connector relative to a mating connector, and it has been rather difficult to effect the insertion and withdrawal of the connector. In view of the difficulty of insertion and withdrawal of such a multi-pole connector, there have now been proposed various connectors (LIF connectors) having an LIF mechanism.

A representative example of such conventional LIF connectors is one in which a connector is inserted and withdrawn by operating a slider.

One such conventional slider-type LIF connector is proposed in Japanese Patent Unexamined Publication No. Hei. 6-215827. The LIF connector, disclosed in Japanese Patent Unexamined Publication No. Hei. 6-215827 will be described with reference to FIGS. 1 to 6.

FIG. 1 shows a first connector (housing) of the LIF connector, and FIG. 1(*a*) is a plan view, and FIG. 1(*b*) is a view as seen along the line D—D of FIG. 1(*a*). FIG. 2 shows a second connector (housing) of the LIF connector, and FIG. 2(*a*) is a plan view, and FIG. 2(*b*) is a cross-sectional view taken along the line E—E of FIG. 2(*a*), and FIG. 2(*c*) is a front-elevational view. FIG. 3 shows a slider of the LIF connector, and FIG. 3(*a*) is a plan view, FIG. 3(*b*) is a cross-sectional view taken along the line F—F of FIG. 3(*a*), and FIG. 3(*c*) is a front-elevational view. FIGS. 4, 5 and 6 are view explanatory of the insertion/withdrawal operation of the LIF connector.

In FIG. 1, the first connector 110 of the LIF connector includes a box-shaped body having an open top, and many terminals (not shown) are provided at an inner bottom surface thereof.

As shown in FIG. 1(*a*), a retaining recess 111 and guide grooves 112 and 112 are formed in each of opposed longitudinal walls 110*a* and 110*a* of the first connector 110.

In FIGS. 1(*a*) and 1(*b*), guides 113 and 113 for respectively guiding rails 133 and 133 of the slider 130 are formed respectively in inner surfaces of the side walls 110*a* and 110*a* at lower ends thereof.

As shown in FIG. 1(*b*), insertion holes 114 and 114 for inserting the slider 130 into the first connector 110 are formed in an end wall 110*b* of the first connector 110, and the insertion holes 114 and 114 communicate with the guides 113 and 113, respectively.

In FIG. 2, the second connector 120 of the LIF connector includes a rectangular box-like body, and many terminals (not shown) are provided at a bottom of the box-like body.

Guide projections 121 and 121 are formed on each of opposed longitudinal walls 120*a* and 120*a* of the second connector 120, and a fixing recess 122 is formed in a central portion of each of the walls 120*a* and 120*a*.

In FIG. 3, the slider 130 of the LIF connector includes a pair of plate-like arms 130*a* and 130*a*, and two slanting cam grooves 131 and 131 are formed in each of the plate-like arms 130*a* and 130*a*. A lance 132 is provided at a central portion of each arm 130*a*, and the lance 132 comprises a resilient plate 132*a*, and an engagement projection 132*b* formed on a distal end of the resilient plate 132*a*.

The rails 133 and 133 are formed respectively on the plate-like arms 130*a* and 130*a*, and extend respectively along lower edges thereof.

The insertion/withdrawal operation of the conventional LIF connector, having the above construction, will now be described with reference to FIGS. 4, 5 and 6.

In FIG. 4, first, the two arms 130*a* and 130*a* of the slider 130 are passed respectively through the insertion holes 114 and 114 in the first connector 110. As a result, the resilient plates 132*a* of the lances 132, provided respectively at the arm 130*a*, are engaged respectively in the retaining recesses 111 formed respectively in the walls 110*a* of the first connector 110, so that the slider 130 is positioned relative to the first connector 110.

In this retained condition, the guide grooves 112 (see FIG. 1) in the first connector 110 are disposed respectively in registry with inlets of the cam grooves 131 in the slider 130. In this condition, when the guide projections 121 of the second connector 120 are introduced respectively into the guide grooves 112 in the first connector 110, the guide projections 121 are guided respectively into the cam grooves 131 in the slider 130, so that the second connector 120 is set on the slider 130.

Then, as shown in FIG. 5, the slider 130 is pushed into the first connector 110. As a result, the engagement between each lance 132 and the associated retaining recess 111 is released, and the second connector 120 descends along the cam grooves 131, and the second connector 120 is completely inserted into the first connector 110 as shown in FIG. 6. At this time, the engagement projections 132*b* of the lances 132 are engaged respectively in the fixing recesses L22 in the second connector 120, thereby fixing the second connector 120 in this fixed condition.

As a result, the terminals in the first connector 110 are connected respectively to the terminals in the second connector 120.

As described above, the purpose of the LIF connector is to reduce a force (insertion/withdrawal force) required for inserting and withdrawing the connector, having many terminals, relative to the mating connector having many terminals, and the LIP connector has the LIF mechanism as means for reducing such insertion/withdrawal force.

In the above conventional LIP connector, however, the lances 132 are provided at the slider 130, and the slider 130 is positioned relative to the first connector 110 through these lances. Therefore, when pushing or pulling the slider 130 so as to insert or withdraw the second connector 120 relative to the first connector 110, the lances 132 of the sliding slider 130 are in press-contact with the opposed walls 120*a* of the second connector 120, respectively, and therefore an extra force is required for pushing and pulling the slider 130.

Therefore, in the conventional LIF connector, the insertion/withdrawal force, required for inserting and withdrawing the connector, could not be sufficiently reduced.

And besides, since the lances 132 are in press-contact with the opposed walls 120*a* of the second connector 120, respectively, during the sliding movement of the slider 130, the engagement projections 132*b* of the lances 132 are worn, or the resilient plates 132*a* are deformed when the slider 130 is repeatedly inserted and withdrawn.

SUMMARY OF THE INVENTION

With the above problems in view, it is an object of this invention to provide an LIF connector in which a slider can be positioned with a simple construction, and an insertion/withdrawal force, required for inserting and withdrawing a connector relative to a mating connector, can be reduced, and wear and deformation of slider-retaining means can be positively prevented.

The above object has been achieved by an LIF (low insertion force) connector, according to a first aspect of the present invention, wherein a driven shaft of a second connector is inserted into a through hole formed in a first connector, and a slider, having cam grooves, is slid over the first connector to linearly move the driven shaft, thereby inserting and withdrawing the second connector relative to the first connector; and a retaining projection, which stops the sliding movement of the slider, and positions inlets of the cam grooves relative to the through hole in the first connector, is formed on the first connector at a substantially rearmost end of an extent of sliding movement of the slider.

More specifically, as in the LIF connector according to a second aspect of the present invention, a retaining recess is formed in the slider, and the retaining projection on the first connector is engaged in the retaining recess, thereby positioning the inlets of the cam grooves in the slider relative to the through hole in the first connector.

Preferably, as in the LIF connector according to a third aspect of the present invention, the retaining projection has a semi-circular cross-section, and the retaining recess has a semi-circular cross-section corresponding to the cross-section of the retaining projection.

Alternatively, as in the LIF connector according to a fourth aspect of the present invention, the retaining projection has a triangular cross-section, and the retaining recess has a triangular cross-section corresponding to the cross-section of the retaining projection.

As in the LIF connector according to a fifth aspect of the present invention, one of the retaining recess and the retaining projection may be resilient.

As recited in a sixth aspect of the present invention, the LIF connector may be so constructed that the retaining projection abuts against a wall of the slider, thereby positioning the inlets of the cam grooves in the slider relative to the through hole in the first connector.

As recited in a seventh aspect of the present invention, the LIF connector may be so constructed that the retaining projection, formed on the first connector, can abut against an inner surface of a wall of the slider, and the wall can slide over the retaining projection, and abutment portions for abutting against each other are formed respectively on the first connector and the slider, and when the retaining projection abuts against the inner surface of the wall of the slider, the retaining projection limits the sliding movement of the slider in one direction, and at the same time the abutment portions abut against each other to limit the slicing movement of the slider in the other direction, thereby positioning the inlets of the cam grooves in the slider relative to the through hole in the first connector.

In the LIF connector of the present invention having the above construction, the retaining projection for positioning the openings of the cam grooves in the slider relative to the through hole in the first connector is formed on the first connector substantially at the rearmost end of the extent of sliding movement of the slider, and therefore the retaining projection will not interfere with the slider during the sliding movement of the slider.

Therefore, the retaining projection will not apply any pressing force to the slider during the sliding movement of the slider, and any extra force is required for sliding the slider. Therefore, the insertion/withdrawal force, required for inserting and withdrawing the second connector relative to the first connector, can be sufficiently reduced.

Since the retaining projection is formed substantially at the rearmost end of the extent of sliding movement of the slider over the first connector, the slider will not slide over this retaining projection, and therefore the retaining projection is positively prevented from being worn and deformed.

In the LIF connector of the invention, by sliding the slider over the first connector, the second connector can be inserted into and withdrawn from the first connector, and therefore the slider can be positioned with the simple construction in which the retaining projection is formed on the first connector.

As in the LIF connector the second aspect of the invention, where the retaining recess, corresponding to the retaining projection, is formed in the slider, the positioned condition of the slider can be maintained. As in the LIF connector of the third or fourth aspect of the present invention, where the retaining projection and the retaining recess have a semi-circular cross-section or a triangular cross-section, the retaining projection can be smoothly engaged in and disengaged from the retaining recess.

As in the LIF connector of the fifth aspect of the present invention, where one of the retaining recess or the retaining projection is resilient, the retaining projection can be more smoothly engaged in and disengaged from the retaining recess.

As in the LIF connector of the sixth aspect of the invention, where the retaining projection abuts against the wall of the slider to thereby position the slider, the reduction of the insertion/withdrawal force for the connectors, as well as the prevention of wear of the retaining projection, can be achieved with a very simple construction although the positioned condition of the slider can not be maintained in contrast with the LIF connector of the second to fifth aspect of the present invention.

As in the LIF connector of the seventh aspect of the present invention, where the sliding movement of the slider is positively limited, thereby positioning the slider, the slider can be positioned more accurately, and this positioned condition can be maintained more accurately.

BRIEF DESCRIPTION OF THE DRAWINGS

FIG. 8(*b*) is a cross-sectional view taken along the line C—C of FIG. 8(*a*);

DESCRIPTION OF THE PREFERRED EMBODIMENTS OF THE INVENTION

One preferred embodiment of an LIF connector of the present invention will now be described with reference to the drawings.

Figure 1A:
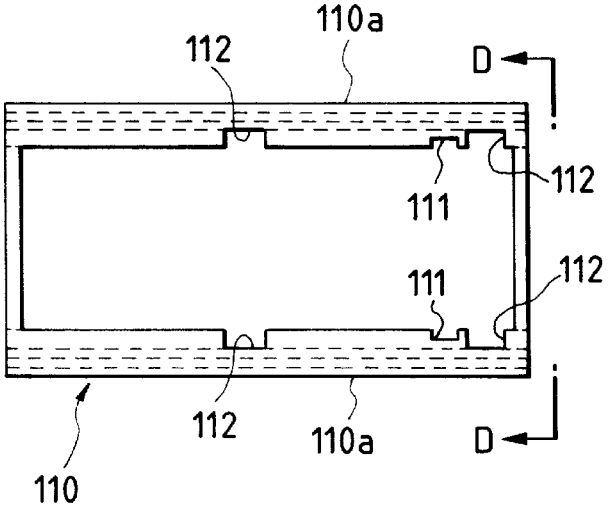
FIG. 1(a) PRIOR ART
FIG. 1(*a*) and 1(*b*) are a plan view of a conventional LIF connector and a cross-sectional view taken along the line D—D of FIG. 1(*a*), respectively.
Figure 1B:
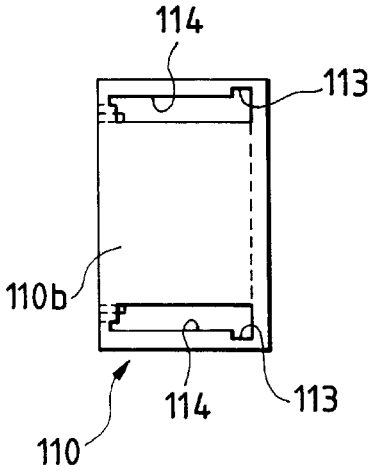
FIG. 1(b) PRIOR ART
Figure 2A:
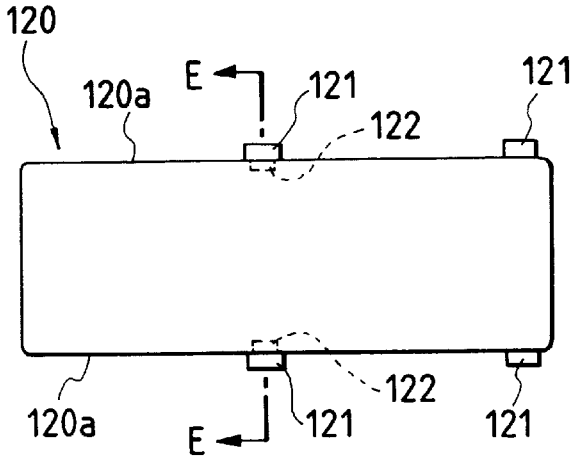
FIG. 2(a) PRIOR ART
FIGS. 2(*a*), 2(*b*) and 2(*c*) are a plan view of a second connector (housing) of the conventional LIF connector, a cross-sectional view taken along the line E—E of FIG. 2(*a*), and a front-elevational view thereof.
Figure 2B:
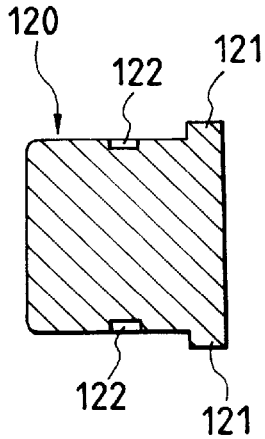
FIG. 2(b) PRIOR ART
Figure 2C:
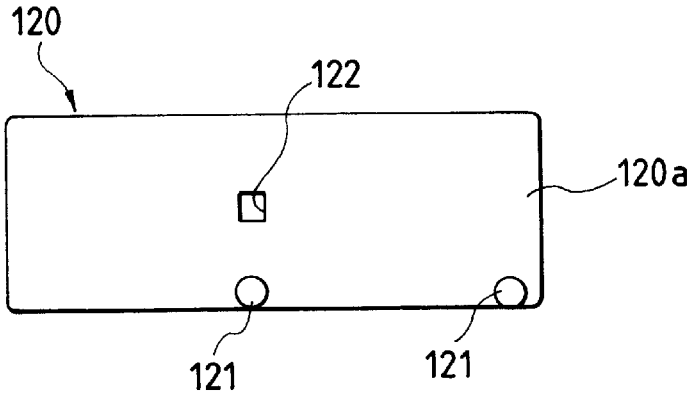
FIG. 2(c) PRIOR ART
Figure 3A:
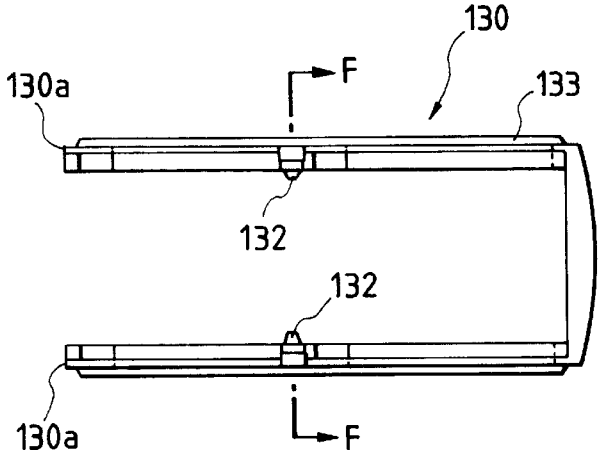
FIG. 3(a) PRIOR ART
FIGS. 3(*a*), 3(*b*) and 3(*c*) are a plan view of a slider of the conventional LIF connector, a cross-sectional view taken along the line F—F of FIG. 3(*a*), and a front-elevational view thereof.
Figure 3B:
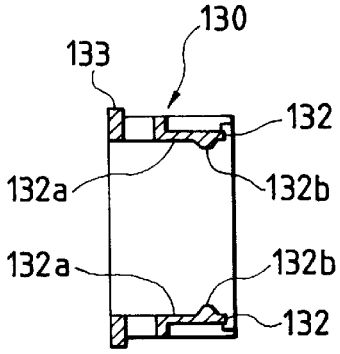
FIG. 3(b) PRIOR ART
Figure 3C:
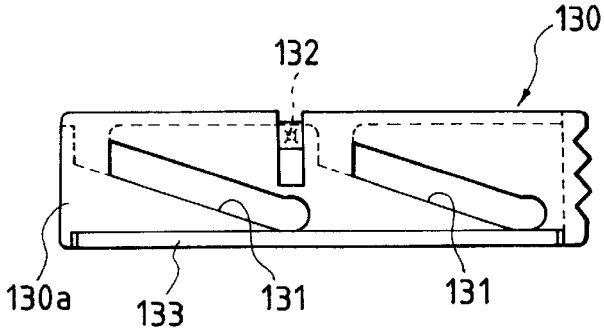
FIG. 3(c) PRIOR ART
Figure 4B:
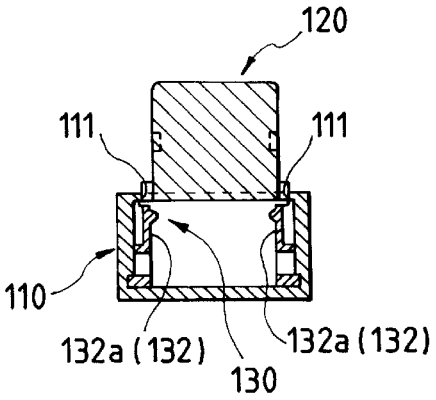
FIG. 4(b) PRIOR ART
FIGS. 4(*a*) and 4(*b*) are a front-elevational view and a cross-sectional view taken along the line G—G of FIG. 4(*a*), respectively, showing a connector insertion/withdrawal operation in the conventional LIF connector.
Figure 4A:
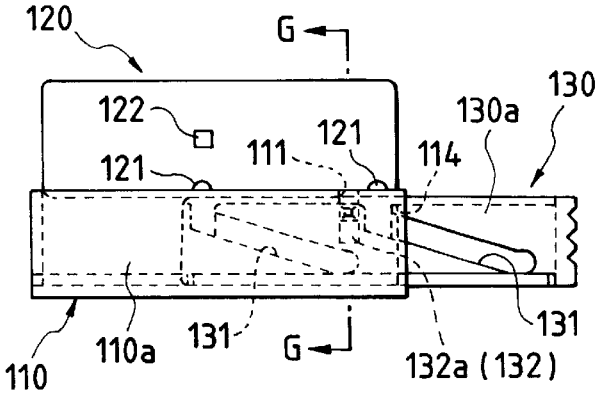
FIG. 4(a) PRIOR ART
Figure 5B:
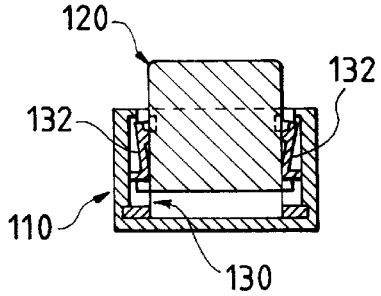
FIG. 5(b) PRIOR ART
FIGS. 5(*a*) and 5(*b*) are a front-elevational view and a cross-sectional view taken along the line H—H of FIG. 5(*a*), respectively, showing the connector insertion/withdrawal operation in the conventional LIF connector.
Figure 5A:
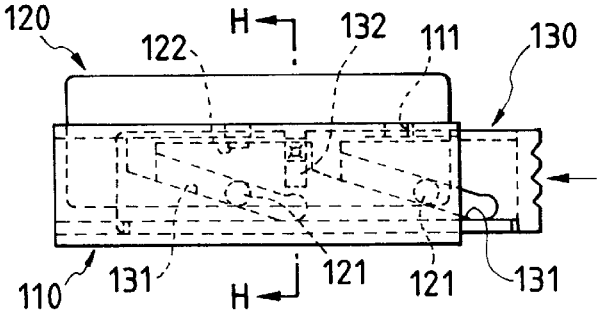
FIG. 5(a) PRIOR ART
Figure 6B:
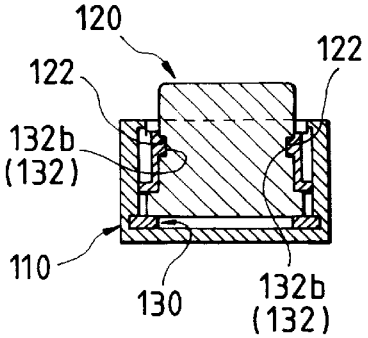
FIG. 6(b) PRIOR ART
FIGS. 6(*a*) and 6(*b*) are a front-elevational view and a cross-sectional view taken along the line I—I of FIG. 6(*a*), respectively, showing the connector insertion/withdrawal operation in the conventional LIF connector.
Figure 6A:
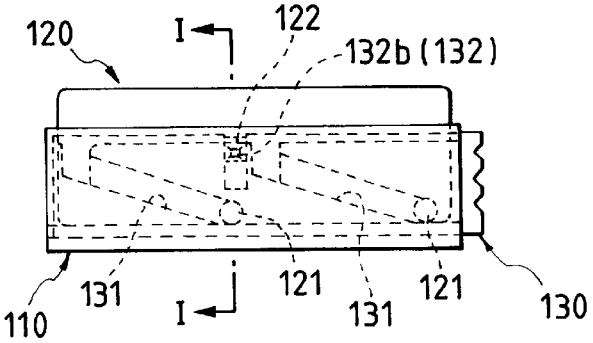
FIG. 6(a) PRIOR ART
Figure 7:
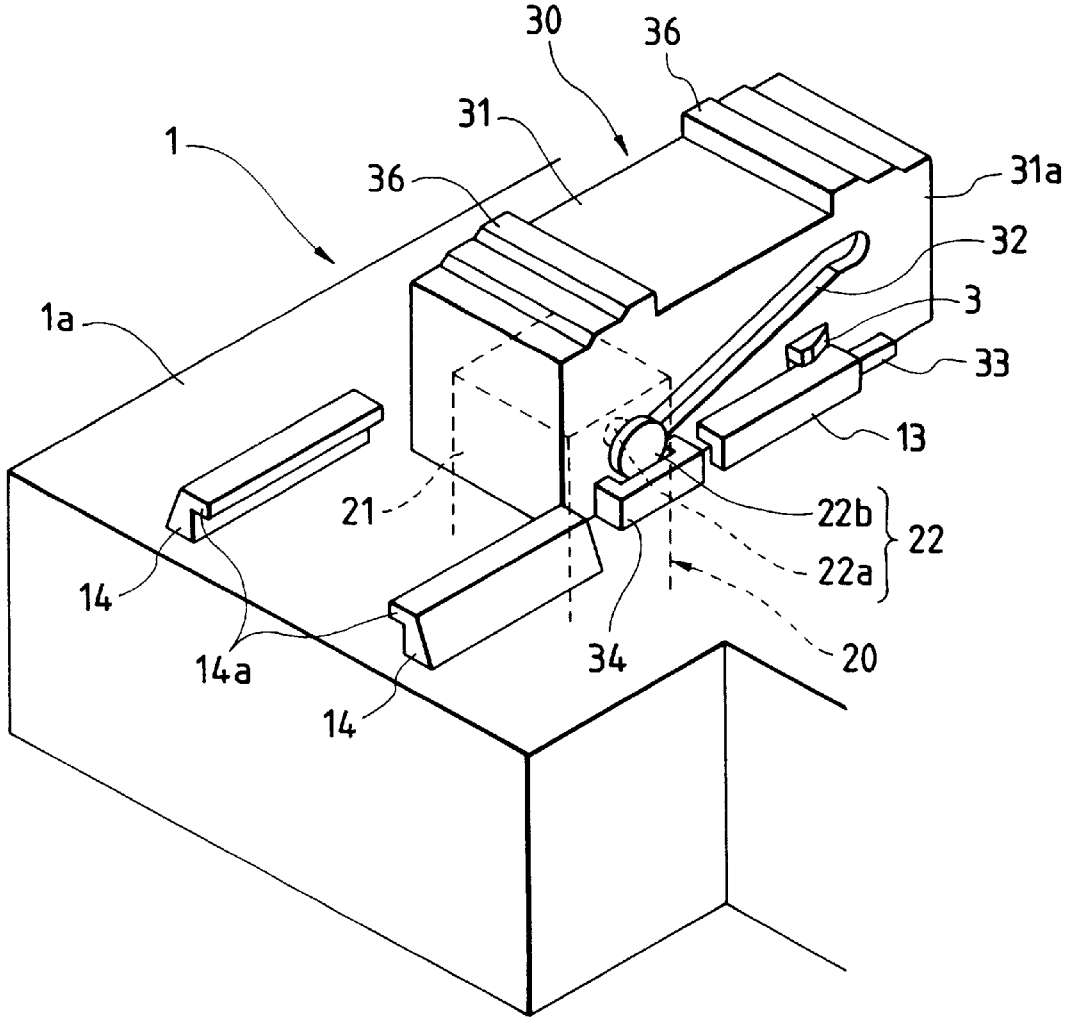
FIG. 7 is a perspective view of one preferred embodiment of an LIF connector of the present invention.

FIG. 7 is a perspective view of one preferred embodiment of the LIF connector of the invention.

Figure 8A:
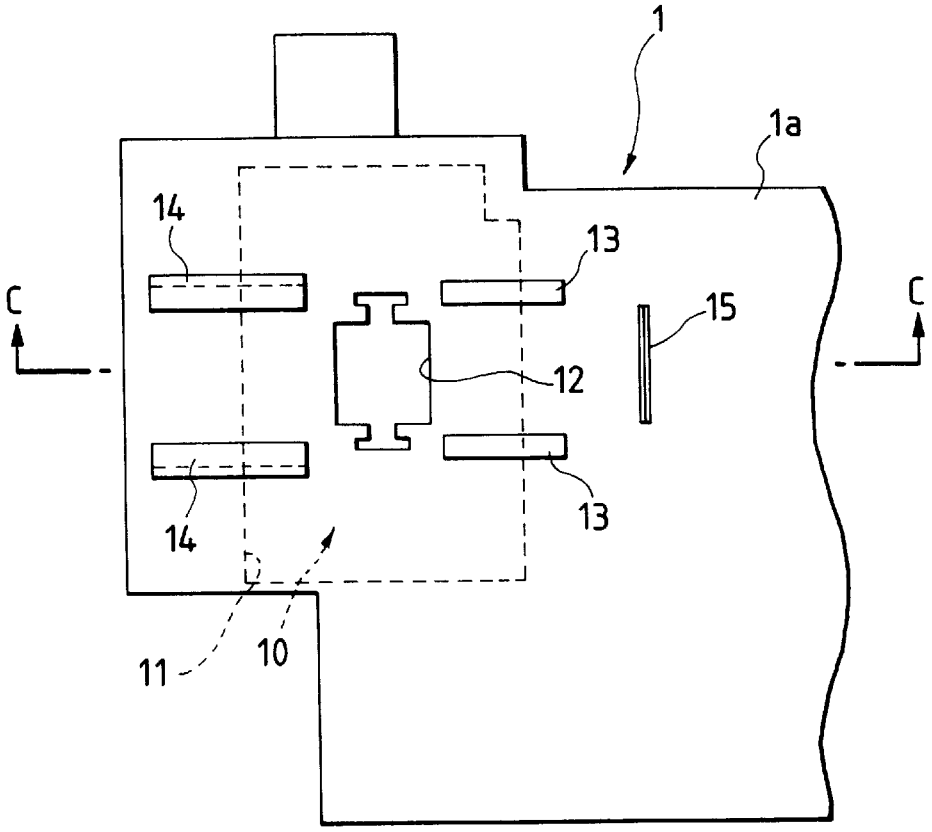
FIG. 8(*a*) is a plan view of a first connector (junction block) of the LIF connector.
Figure 8B:
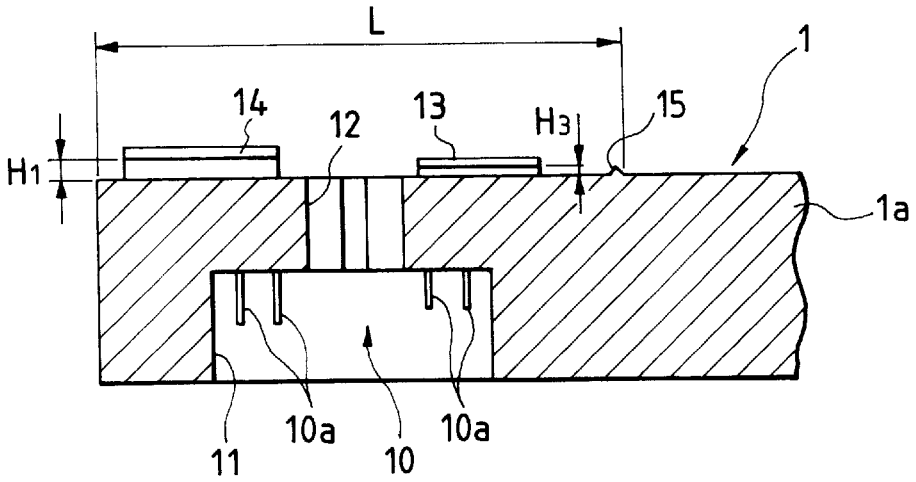
Figure 9:
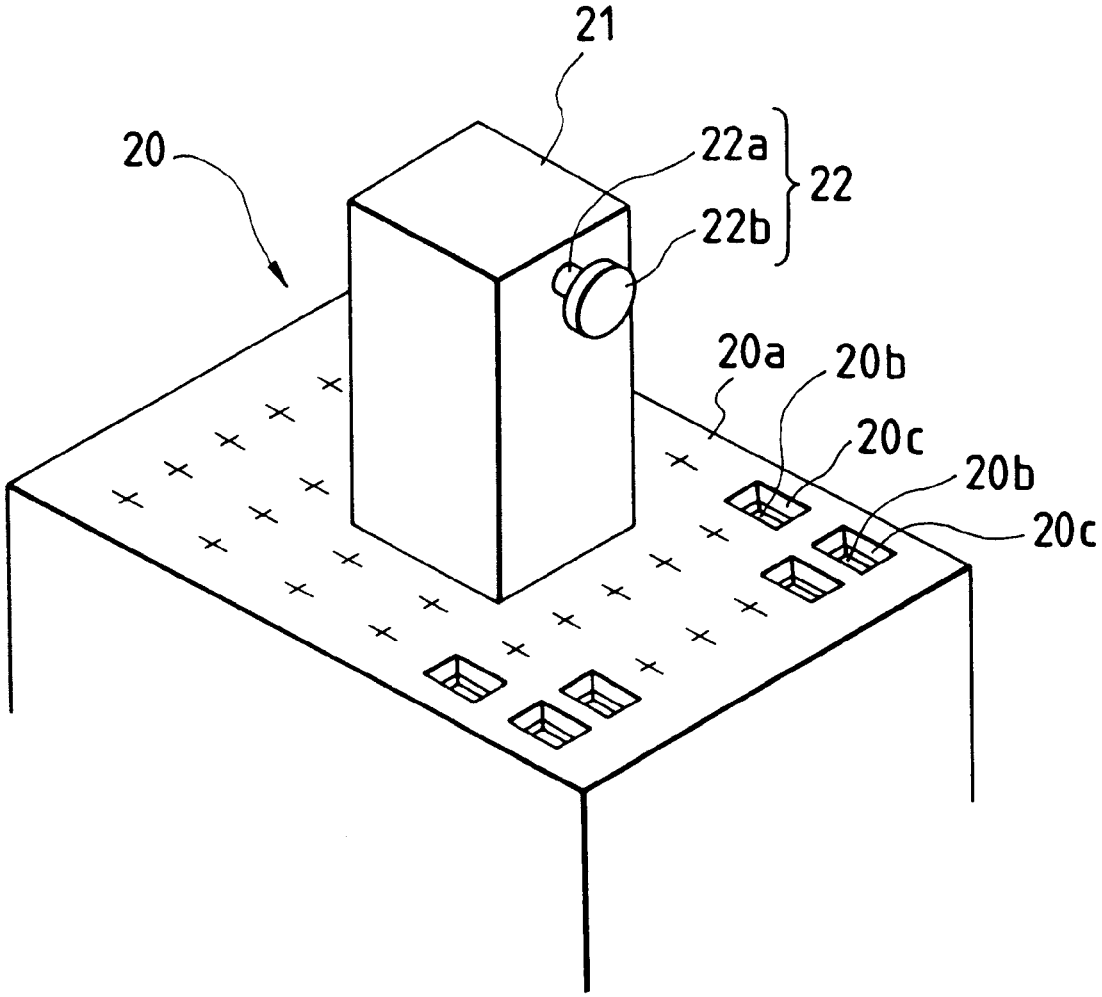
FIG. 9 is a perspective view of a second connector of the LIF connector.
Figure 10A:
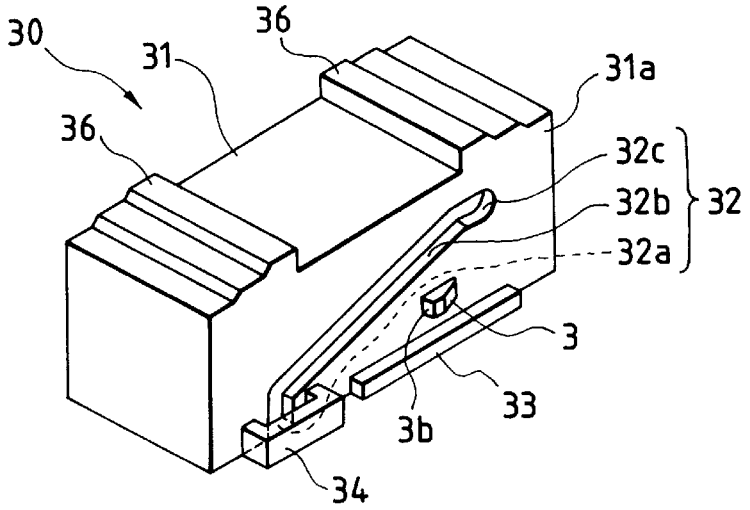
FIGS. 10(*a*), 10(*b*) and 10(*c*) are a perspective view, a front-elevational view and a reverse view of a slider of the LIF connector, respectively.
Figure 10B:
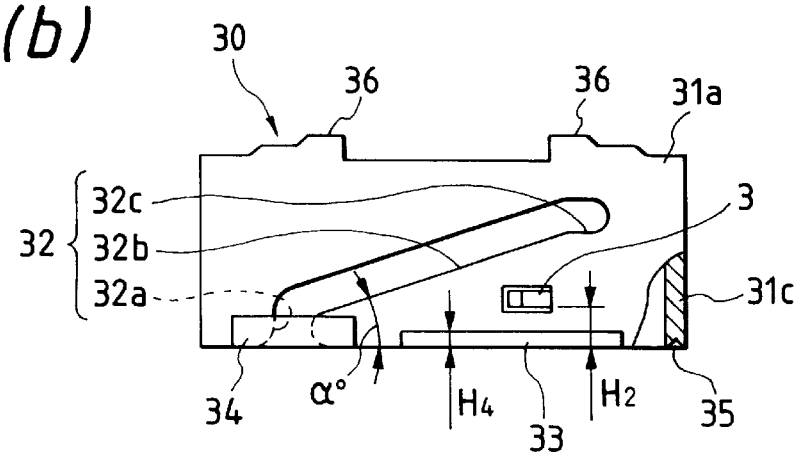
Figure 10C:
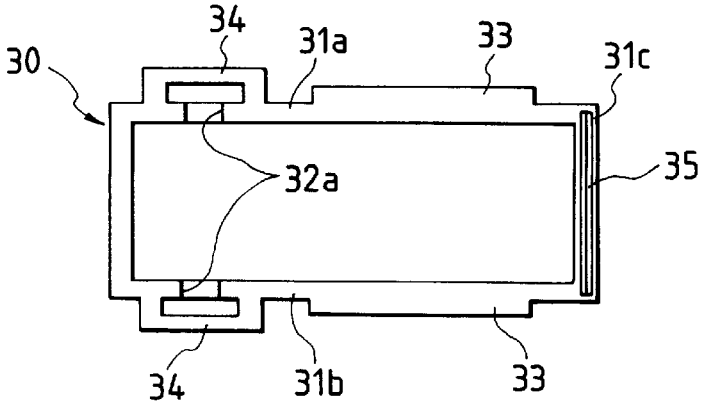

FIG. 8 shows a first connector (junction block) of the LIF connector of this embodiment, and FIG. 8(*a*) is a plan view thereof, and FIG. 8(*b*) is a cross-sectional view taken along the line C—C of FIG. 8(*a*). FIG. 9 is a perspective view of a second connector of the LIF connector. FIG. 10 shows a slider of the LIF connector, and FIG. 10(*a*) is a perspective view thereof, and FIG. 10(*b*) is a front-elevational view thereof, and FIG. 10(*c*) is a reverse view thereof.

The LIF connector of the present invention is characterized particularly in that there are provided a retaining projection and a retaining recess which are used for positioning the slider, and applications have been filed for other portions of the undermentioned embodiment than these retaining projection and recess.

In these Figures, the LIF connector of this embodiment comprises the first connector 10 provided integrally in the junction box 1, the second connector 20 for being inserted into and withdrawn from the first connector 10, and the slider 30 for inserting and withdrawing the second connector 20 relative to the first connector 10.

In FIGS. 7, 8(*a*) and 8(*b*), the first connector 10 is formed integrally in a housing la of the junction box 1, as described above. The first connector 10 includes a reception portion 11 for the second connector 20, and many male terminals 10*a* are projected into this reception portion 11. The male terminals 10*a*, which may be of varying lengths are formed integrally with a bus bar wiring board (not shown) mounted in the junction block 1. A through hole 12, communicating with the reception portion 11, is formed in the housing 1*a*.

Guides 13 and 13 for slidably holding the slider 30 on the housing 1*a*, as well as holder guides 14 and 14, are formed on an upper surface of the housing 1*a*. The guides 13 respectively guide rails 33 and 33 formed on the slider 30, and the holder guides 14 respectively guide holders 34 formed on the slider 30. With this construction, the slider 30 can slide linearly over the housing 1*a*.

The retaining projection or ridge 15 for positioning the slider 30 is formed integrally on the upper surface of the housing 1*a*. The retaining projection 15 is provided at a rearmost end of an extent L of sliding movement of the slider 30, and this retaining projection 15 is engaged in the retaining recess 35, formed in the slider 30, thereby positioning openings (inlets) 32*a* of cam grooves 32 in the slider 30 relative to the through hole 12 in the housing 1*a* (see FIG. 12(*b*)).

The retaining projection 15 has a triangular cross-section, and can be smoothly brought into and out of engagement with the retaining recess 35 in the slider 30.

When the retaining recess 35 slides over the retaining projection 15 so as to achieve and release the engagement therebetween, the slider 30 is slightly lifted, and in view of this, a height $H_3$ of each guide 13 is slightly larger than a height $H_4$ of each rail 33 (see FIGS. 8(*b*) and 10(*b*)), so that a play is formed between the guide 13 and the rail 33.

In FIGS. 7 and 9, a driven shaft 21 for being inserted into the through hole 12 in the first connector 10 is formed upright at a central portion of the second connector 20. Guide pins 22 project perpendicularly from a distal end portion of the driven shaft 21. The guide pin 22 comprises a cylindrical shank portion 22*a*, and a disk-like stopper 22*b*.

Many female terminals 20*b*, corresponding respectively to the male terminals 10*a* of the first connector 10, are provided in a housing 20*a* of the second connector 20. The female terminals 20*b* are mounted respectively in cavities 20*c* formed in the housing 20*a*.

In FIGS. 7, 10(*a*), 10(*b*) and 10(*c*), the slider 30 includes a box-like body 31 having an open bottom, and the slanting cam grooves 32 and 32 for respectively guiding the guide pins 22 of the second connector 20 are formed respectively in opposed longitudinal walls 31*a* and 31*a* of the body 31.

As shown in FIG. 10(*b*), the cam groove 32 has the opening 32*a* for introducing the guide pin 22 of the driven shaft 21, a slanting groove 32*b* continuous with the opening 32*a*, and a horizontal groove 32*c* for stabilizing the guide pin 22 passed through the slanting groove 32*b*.

By reducing an inclination angle $\alpha°$ of the cam groove 32, a force for sliding the slider 30 (that is, an insertion/ withdrawal force for the connectors 10 and 20) can be reduced. In contrast, by increasing the inclination angle α° of the cam groove 32, the distance of sliding of the slider 30 can be reduced.

The rails 33 and 33 are integrally formed respectively on the side walls 31*a* and 31*a* of the body 31, and extend respectively along lower edges of these side walls. The holders 34 and 34 for respectively guiding the guide pins 22 of the second connector 20 into the openings 32*a* are formed respectively on the side walls 31*a* and 31*a*, and are disposed outwardly of the openings 32*a* of the cam groove 32, respectively.

As shown in FIG. 10(*c*), a notch, defining the retaining recess 35 of a triangular cross-section, is formed in a lower end of an end wall 31*c* of the body 31.

Anti-slip portions 36 for enabling the finger to smoothly slide the slider 30 are formed on the upper surface of the slider 30. In this embodiment, although the anti-slip portion 36 has a step-like configuration, it may be replaced by any other suitable configuration, such as a concave-convex configuration and a cross-sectionally serrated configuration in so far as it can prevent a slip of the finger.

Retractable projections 3 for preventing a reverse insertion of the slider are provided resiliently retractably respectively on the opposed longitudinal walls 31*a* and 31*a* of the body 31 of the slider 30. As shown in FIGS. 8(*b*) and 10(*b*), the position $H_2$ of formation of each retractable projection 3 is at the same height or level as the position $H_1$ of formation of an inturned portion 14*a* of the holder guide 14 of the first connector 10. When the slider 30 is inserted between the holder guides 14 with the directions of its front and rear ends reversed, the projections 3 abut respectively against the holder guides 14 to thereby prevent the insertion of the slider 30.

Next, the connector insertion/withdrawal operation in the LIF connector of the invention will be described with reference to FIGS. 11(*a*) to 16(*b*).

Figure 11A:
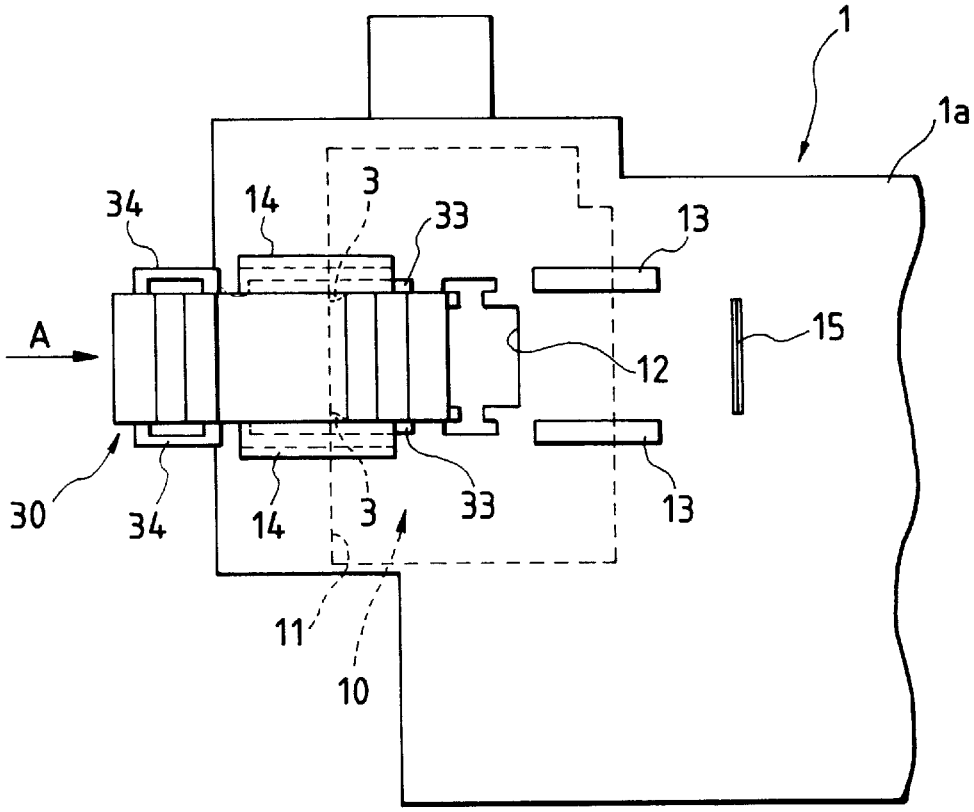
FIGS. 11(*a*) and 11(*b*) are a plan view and a cross-sectional view, showing a sequence of a connector insertion/withdrawal operation in the LIF connector of the above embodiment.
Figure 11B:
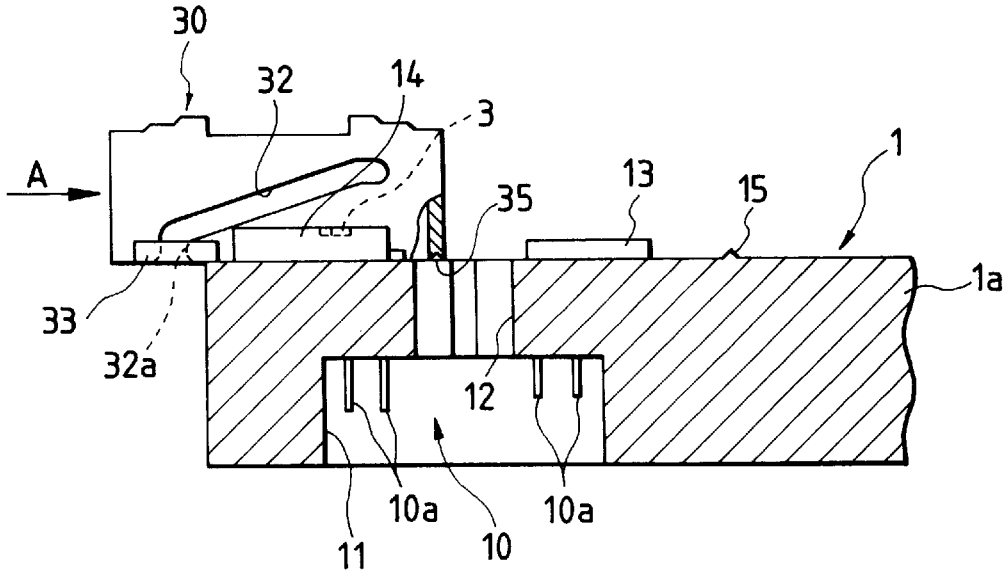

FIGS. 11(*a*) to 16(*b*) show a sequence of the connector insertion/withdrawal operation in the LIF connector of the invention, and FIGS. 11(*a*), 12(*a*), 13(*a*), 14(*a*), 15(*a*) and 16(*a*) are plan views, and FIGS. 11(*b*), 12(*b*), 13(*b*), 14(*b*), 15(*b*) and 16(*b*) are cross-sectional views.

For inserting the second connector 20 into the first connector 10, the slider 30 is first positioned on the first connector 10.

In FIGS. 11(*a*) and 11(*b*), the slider 30 is slid over the housing 1*a* of the first connector 10 in a direction of arrow A, with the rails 33 and 33 directed toward the first connector 10, and the slider 30 is moved toward the retaining projection 15 along the guides 13 and 13 and the holder guides 14 and 14.

Figure 12A:
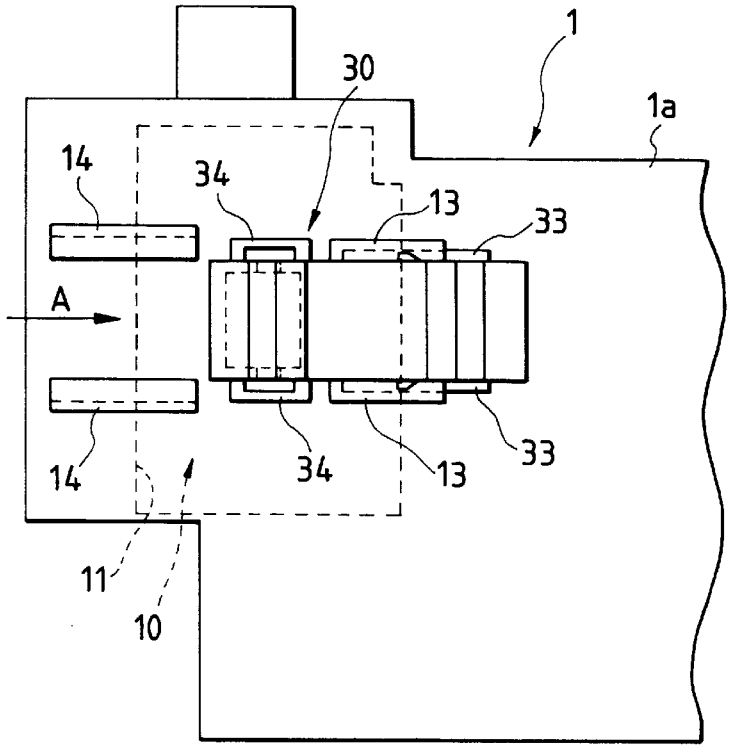
FIGS. 12(*a*) and 12(*b*) are a plan view and a cross-sectional view, showing a sequence of the connector insertion/withdrawal operation in the LIF connector of the above embodiment.
Figure 12B:
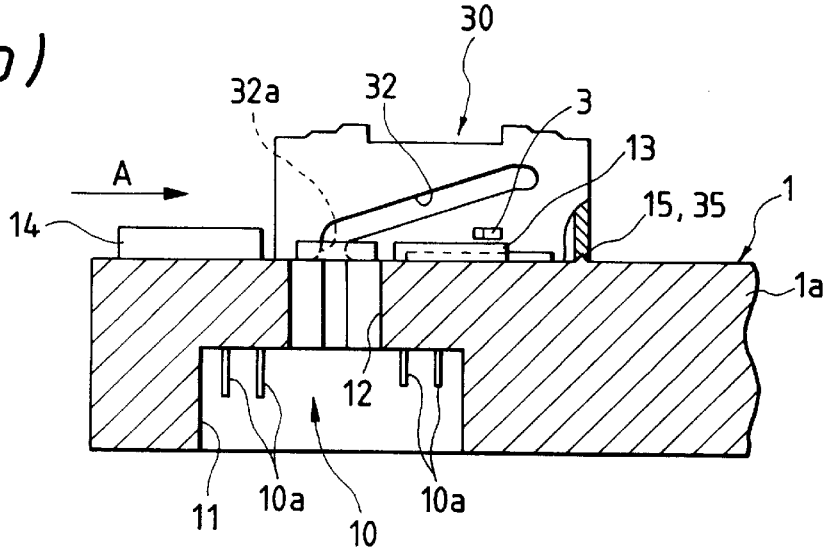

As a result, the retaining recess 35 in the slider 30 is engaged with the retaining projection 15, so that the slider 30 is positioned on the first connector 10, as shown in FIGS. 12(*a*) and 12(*b*). Namely, the openings 32*a* of the cam grooves 32 in the slider 30 are positioned relative to the through hole 12 in the housing 1*a*.

Figure 13A:
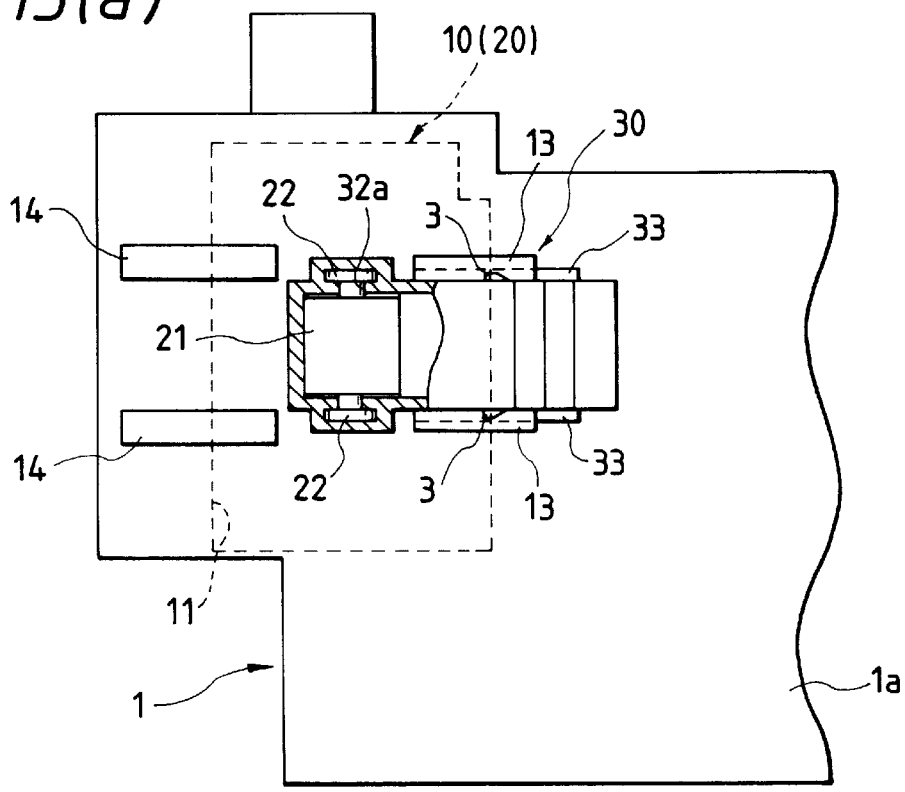
FIGS. 13(*a*) and 13(*b*) are a plan view and a cross-sectional view, showing a sequence of the connector insertion/withdrawal operation in the LIF connector of the above embodiment.
Figure 13B:
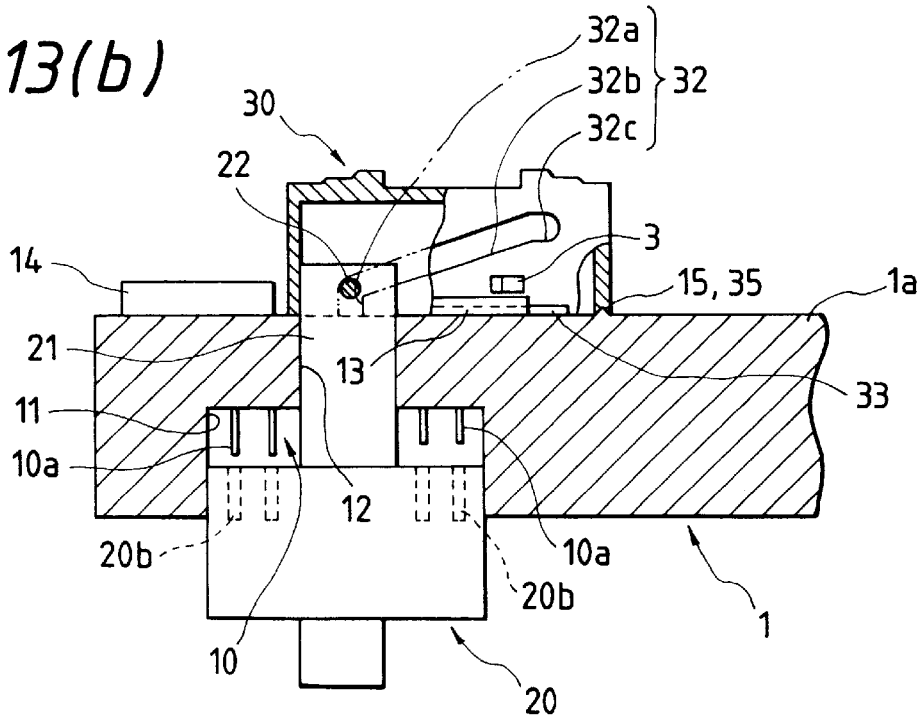

Then, as shown in FIGS. 13(*a*) and 13(*b*), the second connector 20 is inserted into the reception portion 11 of the first connector 10. Then, the openings 32*a* of the cam grooves 32 in the slider 30 are positioned respectively relative to the guide pins 22 on the second connector 20, and the guide pins 22 are introduced respectively into the cam grooves 32 through the respective openings 32*a*.

Figure 14A:
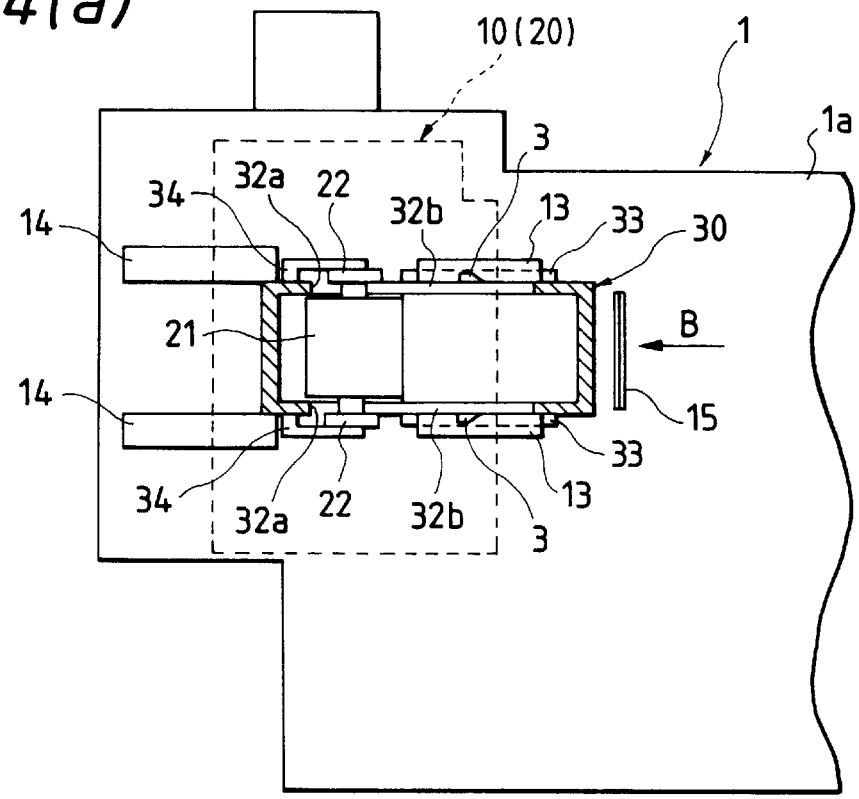
FIGS. 14(*a*) and 14(*b*) are a plan view and a cross-sectional view, showing a sequence of the connector insertion/withdrawal operation in the LIF connector of the above embodiment.
Figure 14B:
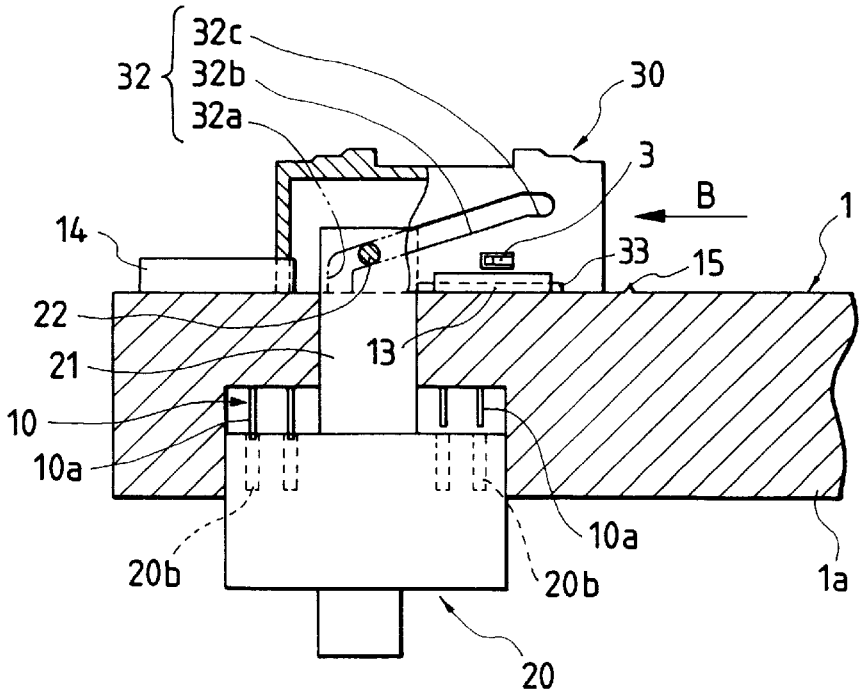

Then, when the slider 30 is slid from the set position in a direction of arrow B as shown in FIGS. 14(*a*) and 14(*b*), the guide pins 22 rise respectively along the slanting grooves 32*b* of the cam grooves 32. As a result, the second connector 20 is pulled toward the upper surface of the reception portion 11 of the first connector 10 through the driven shaft 21.

Figure 15A:
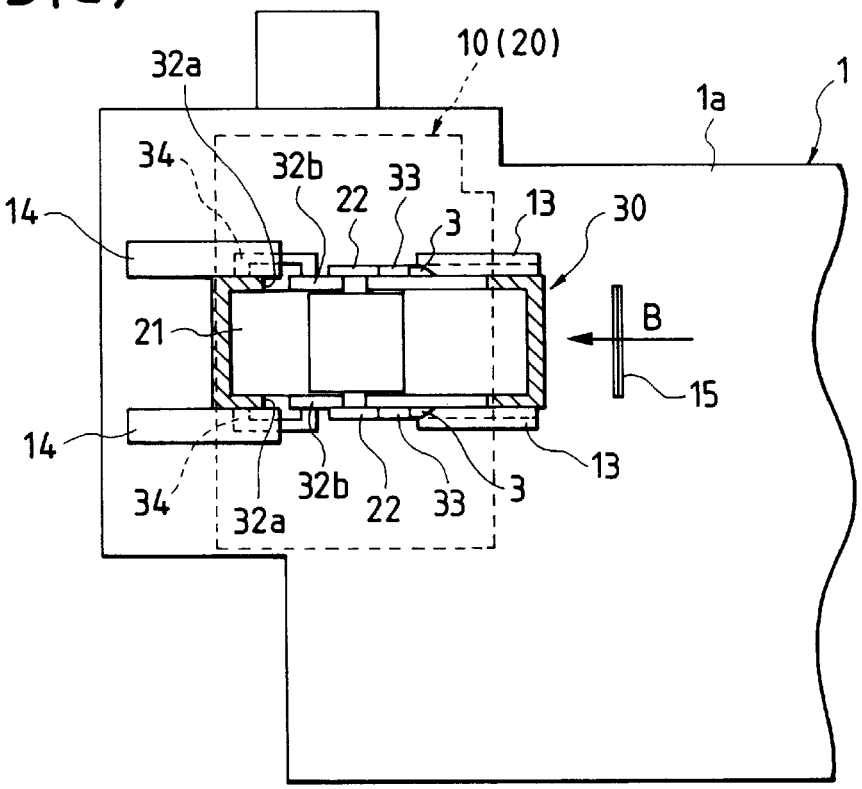
FIGS. 15(*a*) and 15(*b*) are a plan view and a cross-sectional view, showing a sequence of the connector insertion/withdrawal operation in the LIF connector of the above embodiment.
Figure 15B:
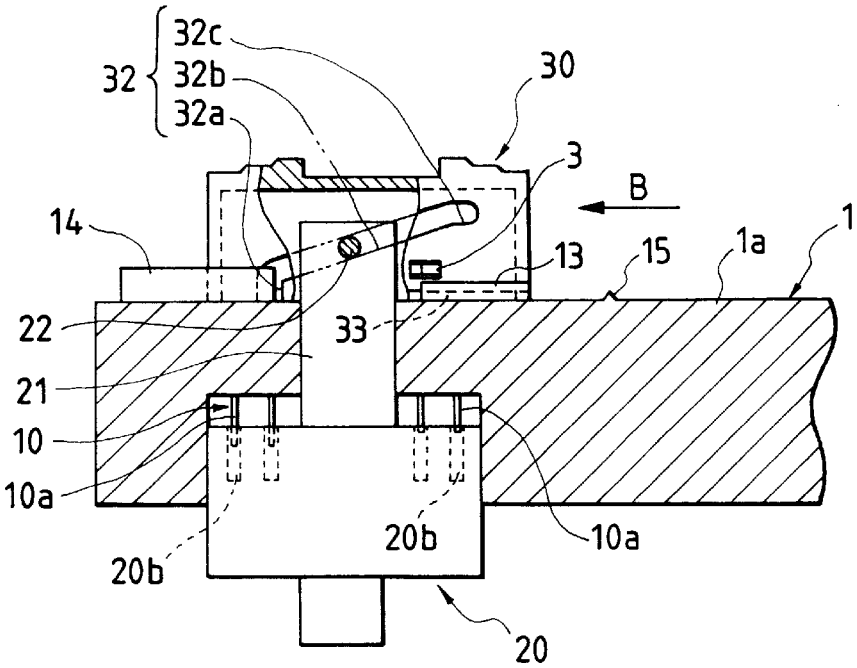
Figure 16A:
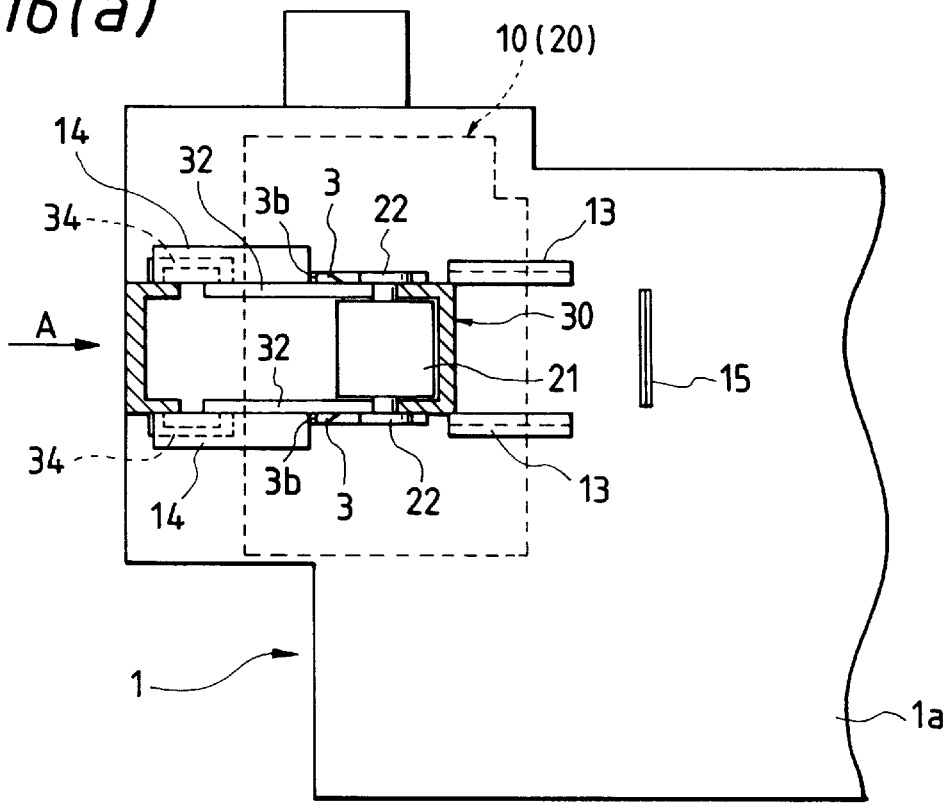
FIGS. 16(*a*) and 16(*b*) are a plan view and a cross-sectional view, showing a sequence of the connector insertion/withdrawal operation in the LIF connector of the above embodiment.
Figure 16B:
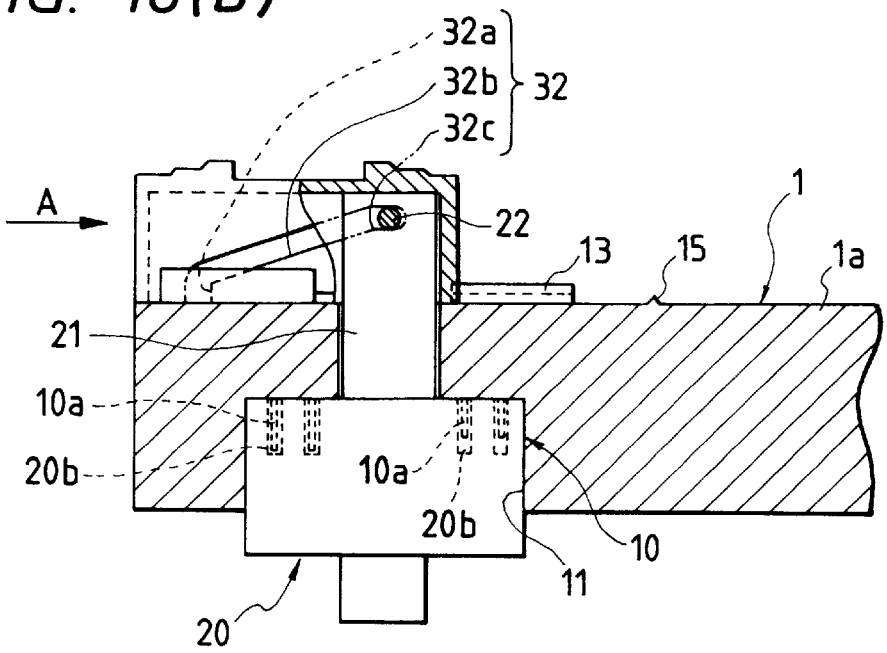

Then, when the slider 30 is further slid in the direction of arrow B as shown in FIGS. 15(*a*) and 15(*b*), each of the guide pins 22 passes past the slanting groove 32*b*, and is introduced into the horizontal groove 32*c* of the cam groove 32 (FIGS. 16(*a*) and 16(*b*)). As a result, the second connector 20 is completely inserted into the reception portion 11 of the first connector 10, and the male terminals 10*a* in the first connector 10 are electrically connected respectively to the female terminals 20*b* in the second connector 20.

When the slider 30 is slid until each guide pin 22 passes through the associated slanting groove 32*b*, an abutment surface 3*b* of each retractable projection 3 abuts against the associated holder guide 14, thereby preventing an undue force from being applied to the guide pin 22 and the horizontal groove 32*c*, as shown in FIG. 16(*a*).

For withdrawing the second connector 20 from the first connector 10, the slider 30 in the condition of FIGS. 16(*a*) and 16(*b*) is slid in the direction of arrow A, so that the cam grooves 32 in the slider 30 perform a function reverse to that described above, and therefore the second connector 20 can be withdrawn from the reception portion 11 of the first connector 10.

In the LIF connector of this embodiment, the retaining projection 15 for positioning the openings 32*a* of the cam grooves 32 in the slider 30 relative to the through hole 12 in the first connector 10 is formed on the first connector 10 at the rearmost end of the extent of sliding movement of the slider 30, and therefore the retaining projection 15 will not interfere with the slider during the sliding movement of the slider 30.

Therefore, the retaining projection 15 will not apply any pressing force to the slider 30 during the sliding movement of the slider 30, and no extra force is required for sliding the slider 30. Therefore, the insertion/withdrawal force, required for inserting and withdrawing the second connector 20 relative to the first connector 10, can be sufficiently reduced.

Since the retaining projection 15 is formed at the rearmost end of the extent of sliding movement of the slider 30 over the first connector 10, the slider 30 will not slide over this retaining projection 15, and therefore the retaining projection 15 is positively prevented from being worn and deformed.

By sliding the slider 30 over the first connector 10, the second connector 20 can be inserted into and withdrawn from the first connector 10, and therefore the slider 30 can be positioned with the simple construction in which the retaining projection 15 is formed on the first connector 10.

By engaging the retaining projection 15 of the first connector in the retaining recess 35 in the slider 30, the slider 30 can be positioned, and therefore the retaining projection 15 can be smoothly engaged in and disengaged from the retaining recess 35.

Next, a second embodiment of an LIF connector of the invention will be described with reference to FIGS. 17(*a*) and 17(*b*).

Figure 17A:
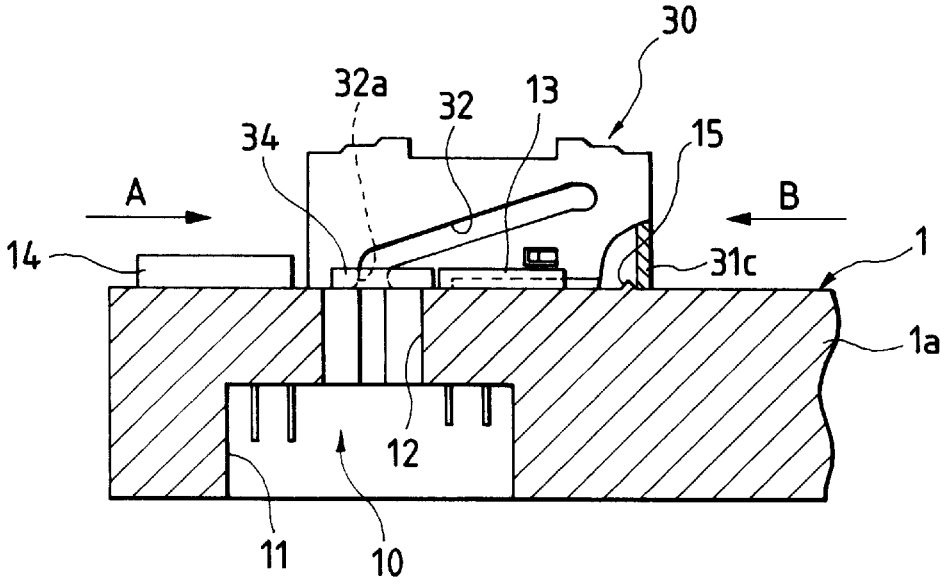
FIGS. 17(*a*) and 17(*b*) are cross-sectional views showing a second embodiment of an LIF connector of the invention.
Figure 17B:
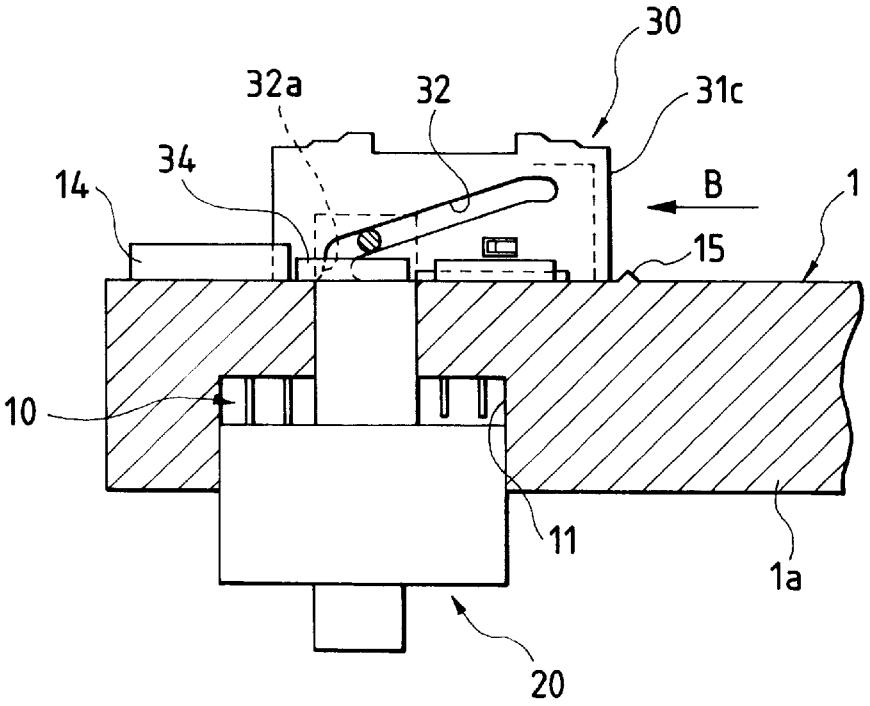

FIGS. 17(*a*) and 17(*b*) are cross-sectional views of the second embodiment of the LIF connector of the invention.

As shown in FIG. 17(*a*), a retaining projection 15 of a triangular cross-section is formed on a housing 1*a* of a first connector 10, and this retaining projection 15 can abut against an inner surface of a wall 31*c* of a slider 30, and this wall 31*c* can slide over the retaining projection 15. Holders 34 of the slider 30 have a slightly-increased length, and when the retaining projection 15 abuts against the wall 31*c* of the slider 30, the holders 34 abut respectively against ends of guides 13 formed on the first connector 10.

In the LIF connector of this embodiment having the above construction, when the slider 30 is slid over a housing 1*a* in a direction of arrow A, the holders (abutment portions) 34 abut respectively against the guides (abutment portions) 13, thereby limiting the sliding movement of the slider 30 in the direction of arrow A, and at the same time the retaining projection 15 abuts against the inner surface of the wall 31*c* of the slider, thereby limiting the sliding movement of the slider 30 in a direction of arrow B, and openings 32*a* of cam grooves 32 in the slider 30 are positioned relative to a through hole 12 in the first connector 10.

Then, a second connector 20 is inserted into a reception portion 11 in the first connector 10, and guide pins 22 of the second connector 20 are introduced respectively into the cam grooves 32 through the respective openings 32*a*.

Then, the slider 30 is pushed in the direction of arrow B with a small force, thereby disengaging the wall 31*c* from the retaining projection 15, as shown in FIG. 17(*b*), and the second connector 20 is mounted in the first connector as described above for FIGS. 14 to 16.

In the LIF connector of this embodiment, the slider 30 can be positioned in such a manner that the slider is prevented from sliding movement in the directions of arrows A and B, and therefore the positioning can be effected more accurately, and besides this positioned condition can be maintained more positively.

Figure 18A:
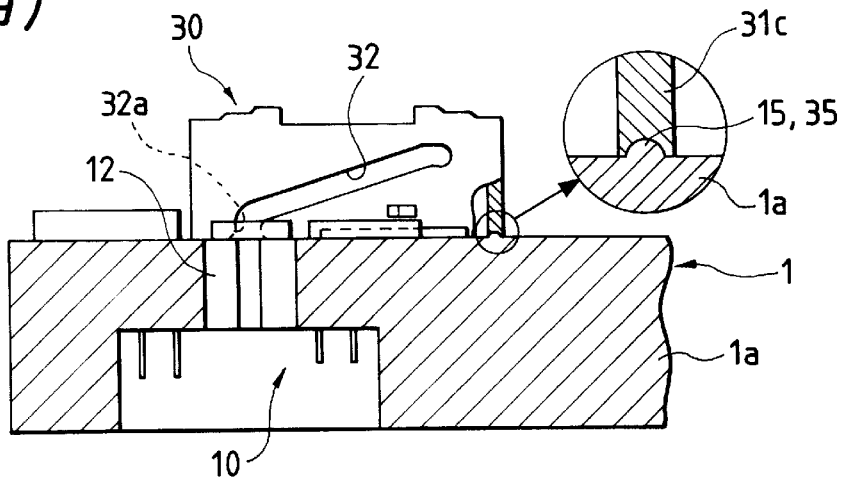
FIGS. 18(*a*), 18(*b*) and 18(*c*) are cross-sectional views showing modified LIF connectors of the invention, respectively.
Figure 18B:
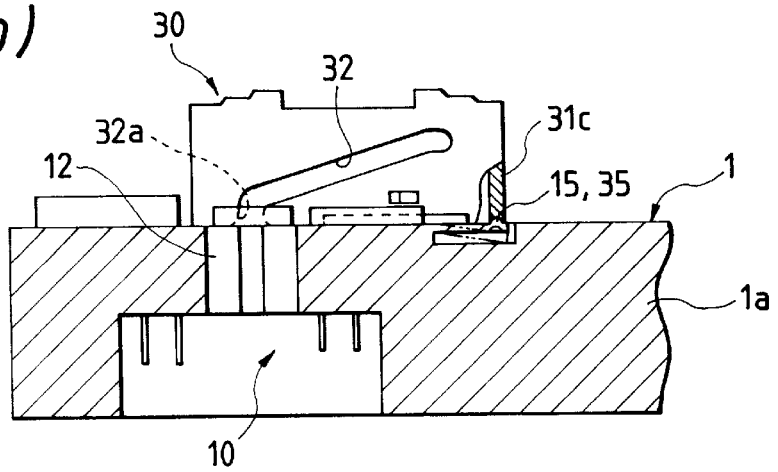
Figure 18C:
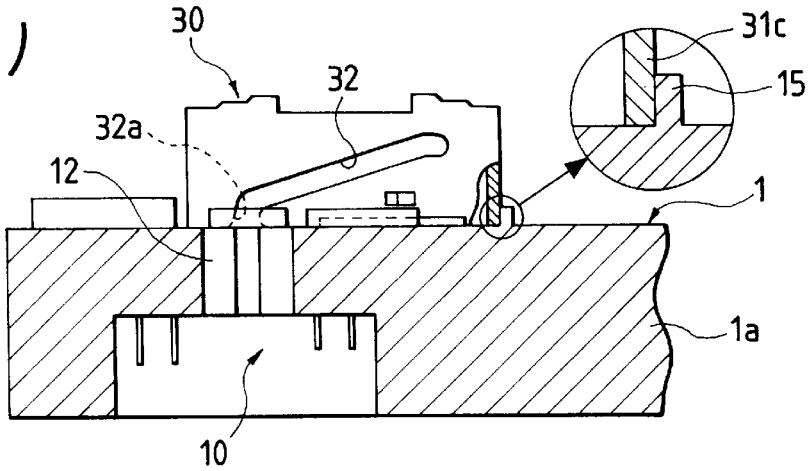

The LIF connectors of the present invention are not limited to the above embodiments, and for Example, the retaining projection 15 and the retaining recess 35 do not need to have a triangular cross-section, but may have a semi-circular cross-section as shown in FIG. 18(*a*).

FIG. 18(*b*) shows a modified form of the invention in which a retaining projection 15 is resiliently mounted on a housing la of a first connector 10, and with this construction the retaining projection 15 can be more smoothly engaged in and disengaged from a retaining recess 35.

FIG. 18(*c*) shows another modified form of the invention in which a retaining projection 15 can abut against an outer surface of a wall 31*c* of a slider 30, thereby positioning openings 32*a* of cam grooves 32 in the slider 30 relative to a through hole 12 in a first connector 10.

In this construction, although the positioned condition of the slider 30 can not be maintained, the reduction of the insertion/withdrawal force for the connectors 10 and 20, as well as the prevention of wear of the retaining projection 15, can be achieved with the very simple positioning construction.

In the above embodiments, although the first connector 10 is integrally formed in the housing la of the junction box 1, the first connector can have an independent housing.

As described above, in the LIF connectors of the present invention, with the simple construction in which the retaining projection is formed on one of the connectors, the slider can be positioned, and also the insertion/withdrawal force for the connectors can be sufficiently reduced, and besides wear and deformation of the slider-retaining means can be positively prevented.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. An LIF connector comprising:

a first connector having a through hole;

a second connector inserted and withdrawn relative to said first connector, said second connector having a driven shaft which is inserted into said through hole of said first connector;

a slider, having cam grooves, slid along an outside surface of said first connector to linearly move said driven shaft, thereby inserting and withdrawing said second connector relative to said first connector;

wherein a retaining projection, which stops the sliding movement of said slider, and positions inlets of said cam grooves relative to said through hole of said first connector, is formed on said outside surface of said first connector at a substantially rearmost end of an extent of sliding movement of said slider.

2. The LIF connector according to claim 1, wherein a retaining recess is formed in said slider, and said retaining projection of said first connector is engaged in said retaining recess, so as to position the inlets of said cam grooves in said slider relative to said through hole in said first connector.

3. The LIF connector according to claim 2, wherein said retaining projection has a semi-circular cross-section, and said retaining recess has a semi-circular cross-section corresponding to the cross-section of said retaining projection.

4. The LIF connector according to claim 2, wherein said retaining projection has a triangular cross-section, and said retaining recess has a triangular cross-section corresponding to the cross-section of said retaining projection.

5. The LIF connector according to claim 2, wherein one of said retaining recess and said retaining projection is resilient.

6. The LIF connector according to claim 3, wherein one of said retaining recess and said retaining projection is resilient.

7. The LIF connector according to claim 4, wherein one of said retaining recess and said retaining projection is resilient.

8. The LIF connector according to claim 1, wherein said retaining projection abuts against a wall of said slider so as to position the inlets of said cam grooves in said slider relative to said through hole in said first connector.

9. The LIF connector according to claim 1, wherein said retaining projection, formed on said first connector, is abutted against an inner surface of a wall of said slider, said wall is slidable over said retaining projection, abutment portions to abut against each other are formed respectively on said first connector and said slider, and when said retaining projection abuts against the inner surface of said wall of said slider, said retaining projection limits the sliding movement of said slider in one direction, and at the same time said abutment portions abut against each other to limit the sliding movement of said slider in the other direction so as to position the inlets of said cam grooves in said slider relative to said through hole in said first connector.

10. An LIF connector comprising:

a first connector having a through hole;

a second connector inserted and withdrawn relative to said first connector, said second connector having a driven shaft which is inserted into said through hole of said first connector;

a slider, having cam grooves, slid over said first connector to linearly move said driven shaft, thereby inserting and withdrawing said second connector relative to said first connector;

wherein a retaining projection, which stops the sliding movement of solid slider, and positions inlets of said cam grooves relative to said through hole of said first connector, is formed on said first connector at a substantially rearmost end of an extent of sliding movement of said slider;

wherein a retaining recess is formed in said slider, and said retaining projection of said first connector is engaged in said retaining recess, so as to position the inlets of said cam grooves in said slider relative to said through hole in said first connector; and wherein said retaining projection has a semi-circular cross-section, and said retaining recess has a semi-circular cross-section corresponding to the cross-section of said retaining projection.

11. An LIF connector comprising:

a first connector having a through hole;

a second connector inserted and withdrawn relative to said first connector, said second connector having a driven shaft which is inserted into said through hole of said first connector;

a slider, having cam grooves, slid over said first connector to linearly move said driven shaft, thereby inserting and withdrawing said second connector relative to said first connector;

wherein a retaining projection, which stops the sliding movement of said slider, and positions inlets of said cam grooves relative to said through hole of said first connector, is formed on said first connector at a substantially rearmost end of an extent of sliding movement of said slider;

wherein a retaining recess is formed in said slider, and said retaining projection of said first connector is engaged in said retaining recess, so as to position the inlets of said cam grooves in said slider relative to said through hole in said first connector; and wherein said retaining projection has a triangular cross-section, and said retaining recess has a triangular cross-section corresponding to the cross-section of said retaining projection.

12. An LIF connector comprising:

a first connector having a through hole;

a second connector inserted and withdrawn relative to said first connector, said second connector having a driven shaft which is inserted into said through hole of said first connector;

a slider, having cam grooves, slid over said first connector to linearly move said driven shaft, thereby inserting and withdrawing said second connector relative to said first connector;

wherein a retaining projection, which stops the sliding movement of said slider, and positions inlets of said cam grooves relative to said through hole of said first connector, is formed on said first connector at a substantially rearmost end of an extent of sliding movement of said slider; and wherein said retaining projection, formed on said first connector, is abutted against an inner surface of a wall of said slider, said wall is slidable over said retaining projection, abutment portions to abut against each other are formed respectively on said first connector and said slider, and when said retaining projection abuts against the inner surface of said wall of said slider, said retaining projection limits the sliding movement of said slider in one direction, and at the same time said abutment portions abut against each other to limit the sliding movement of said slider in the other direction so as to position the inlets of said cam grooves in said slider relative to said through hole in said first connector.

13. The LIF connector according to claim 10, wherein one of said retaining recess and said retaining projection is resilient.

14. The LIF connector according to claim 11, wherein one of said retaining recess and said retaining projection is resilient.

* * * * *